United States Patent [19]

Granieri

[11] Patent Number: 4,689,925

[45] Date of Patent: Sep. 1, 1987

[54] IN A BUILDING A CORNICE BETWEEN A WALL AND A CEILING BOTH MADE OF MODULAR PANELS

[75] Inventor: Luigi Granieri, Pantalla, Italy

[73] Assignee: GN/PI de Luigi Granieri e Figli, S.n.c., Perugia, Italy

[21] Appl. No.: 910,725

[22] Filed: Sep. 23, 1986

[30] Foreign Application Priority Data

Sep. 25, 1985 [IT] Italy ..... 36192/85[U]

[51] Int. Cl.[4] ..... E04B 7/00; E04D 3/40

[52] U.S. Cl. ..... 52/94; 52/9 D; 52/262; 52/282

[58] Field of Search ..... 52/94, 95, 96, 9 D, 52/262, 282

[56] References Cited

U.S. PATENT DOCUMENTS

| | | | |
|---|---|---|---|
| 3,312,018 | 4/1967 | Fourmanoit | 52/90 |
| 3,353,863 | 11/1967 | Koot | 52/262 X |
| 3,783,563 | 1/1974 | Moore | 52/90 X |
| 3,832,818 | 9/1974 | Nahr | 52/731 |
| 3,943,672 | 3/1976 | O'Sheeran | 52/90 X |
| 4,018,021 | 4/1977 | Dow | 52/262 X |
| 4,295,304 | 10/1981 | Kim | 52/90 |

FOREIGN PATENT DOCUMENTS

| | | | |
|---|---|---|---|
| 530238 | 7/1955 | Italy | 52/90 |

*Primary Examiner*—Alfred C. Perham

*Attorney, Agent, or Firm*—Stevens, Davis, Miller & Mosher

[57] ABSTRACT

A protective peripheral cornice of a building which cornice is an equal angle broad flanged beam inserted between the top of the wall and the end section of the ceiling. Such beam is made of light material which is totally enveloped in a metal sheet except for two interruptions in each of which the sheet is replaced by bridgelike means of insulating plastic material which extend for about ½ the panel thickness; one of said interruptions being located across the horizontal median plane of the roof panel while the other is located across the vertical median plane of the wall panel. Such interruptions having thus the function of thermal insulations or thermal barriers.

3 Claims, 1 Drawing Figure

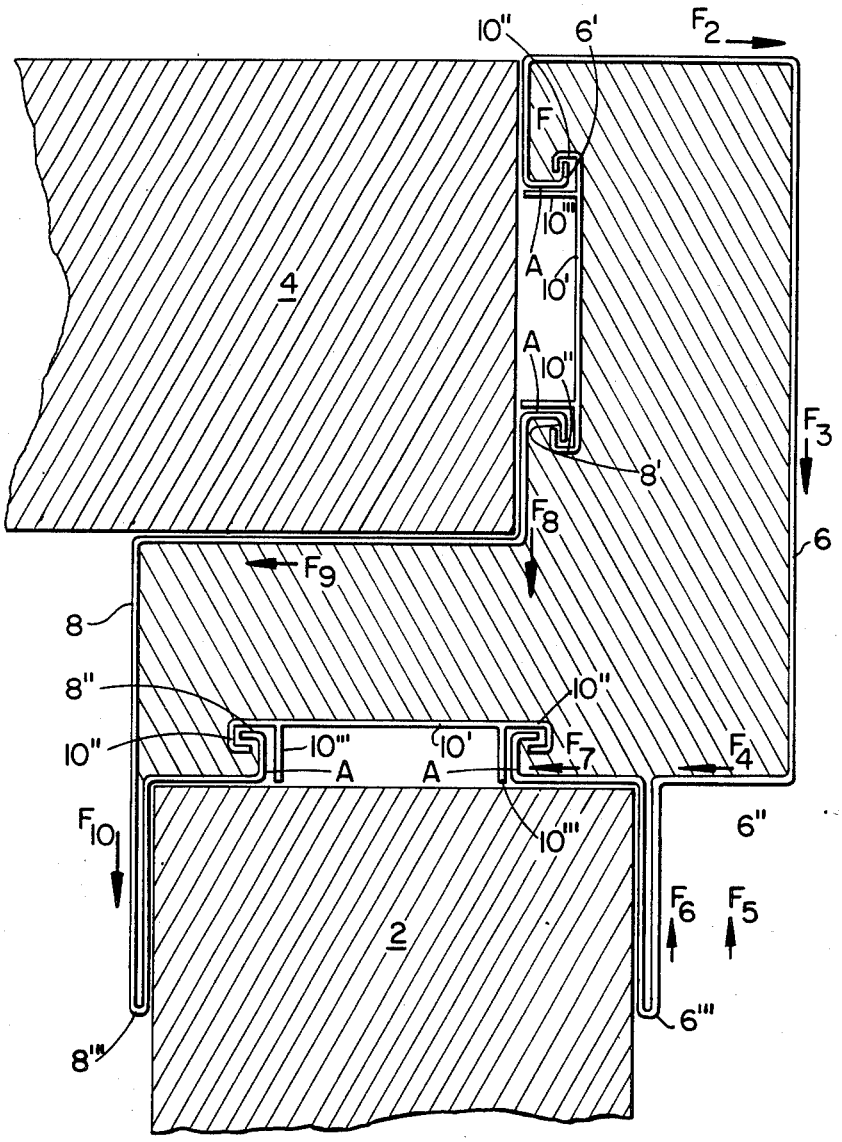
10"
6'
F2
F
10'''
A
10'
4
A
10"
F3
8'
F8
6
F9
8
8"
10"
10"
10'''
10'
F7
F4
A
A
F10
10'''
6"
F6
F5
2
6'''
8'''

IN A BUILDING A CORNICE BETWEEN A WALL AND A CEILING BOTH MADE OF MODULAR PANELS

In prefabricating a light building with modular panels of insulating material the need occurs of joining vertical walls to a horizontal ceiling or covering by assembling and uniting standardized parts such as panels by means of metal junction elements. For instance such metal elements may comprise metal sheet profiles which profiles are filled with insulated material to make a protective beam. For instance, such beams can be disposed in a way that cover the top of a wall and face the end section of a ceiling panel whereby they form a cornice which protects and weatherproofs both the top surface of the wall and the end section of the ceiling panels.

In such a case because said elements whereby the building wall and the ceiling are joined together are exposed in great degree to the surrounding atmosphere and because they are heat good conductors they can convey a lower temperature from the outside towards the inside of the building where they also function as condensating surfaces and produce on the inner wall oxidizations, sfains, molds and the like.

The problem thus arises of interrupting the cornice profile sheet for the whole lenght thereof by means of bridges which, while having the same mechanical strength as the profile can work as thermal insulations whereby that portion of the metal profile which is exposed to the atmosphere is thermally insulated against the portions of the building which are exposed to the inner atmosphere of the building.

The drawing FIG. 1 shows a section of the cornice between a wall and ceiling.

The present invention will appear clearer from the following description thereof and from the attached drawing.

With reference to the drawing an equal angle broad flanged beam is shown which runs along the top end of a wall 2 and which is made of insulating material panels and the end section of a ceiling 4 which is also made of insulating material panels the dimensions of the panels being standardized that is uniform both for the wall and for the ceiling. Said ends are connected at a right angle with one another by means of two steel sheet profiles of which one 6 is partially exposed to the atmosphere and the other is exposed to the building inner atmosphere.

Profile 6 begins with a flat surface 6' which, starting from a level lower than the upper surface of the ceiling 4 at short distance from the end thereof extends downwards for a short distance and then it bends at a right angle and proceeds for a short distance towards the ceiling 4 end to reach the same. At this position it bends at right angle upwards and proceeds according to arrow $F_1$ while adhering to the ceiling end up to the ceiling surface. From this position it bends again at a right angle and proceeds along the upper level of ceiling 4 while getting away—according to arrow $F_2$—from the latter for a distance equal to about one half the panel thickness. From this position, it bends at a right angle to depend vertically—according to arrow $F_3$—to reach the level of the top surface of wall 2, it bends then again at a right angle towards the same surface to reach it—according to arrow $F_4$—and then descends vertically—according to arrow $F_4$—for a distance equal to about half the panel thickness; from this position it folds and proceedes upwards—according to arrow $F_6$—to the level of the top end of wall 2 wherefrom it bends at a right angle and, while adhering to the top surface of wall 2, it proceeds—according to arrow $F_7$—for a distance equal to about $\frac{1}{4}$ of the panel thickness; it bends then vertically for a short distance and lastly for a further short horizontal distance (about 1/10 the panel thickness).

The inner profile 8 that is the profile exposed to the building inner atmosphere begins at a point which is symmetrical to that where the profile 6 begins with respect to the median plane D-D of the ceiling 4 and extends—according to arrow $F_8$—to reach the level of the ceiling lower surface.

At this position it bends at a right angle towards the building inside and proceeds—according to arrow $F_9$—adjacent to the ceiling lower surface to reach the plane on which the inner surface of the wall lies; from this position it bends at right angle and descends—according to arrow $F_{10}$—to reach the same lowermost position as profile 6; from this position it folds and proceeds upwards to the level of the top end of wall 2 and then it bends at right angle towards the building outside and proceeds to follow a pattern symmetrical to that of profile 6 with respect to the median plane E-E of wall 2. By this configuration two thermal insulations A and A' have been obtained at the ends of profiles 6 and 8.

At such insulations said profiles terminate with a clamping edge 6',8';6'',8''.

The distances between the clamping edges 6',8' and the clamping edges 6'',8'' are identical and between them a plastic material is inserted which has the shape of a small bridge in as much as it comprises a flat deck 10' of which the lenght is the same as said profiles 6 and 8 and the width of which is slightly greater than the distance between the corresponding clamping edges by which the respective thermal insulations A-A' are determined.

Along the clamping edges 10'' of small bridge 10 this is provided with two walls 10''' perpendicular to the deck 10' which walls have the same legth as the profiles 6,8 and nearly the same height as clamping edges 6',8' and 6'',8''. Walls 10''' serve for centering the profiles 6 and 8 between the same clamping edges.

The descending folded sections 6''' and 8''' of profiles 6 and 8 display a static function of mechanical restrained coupling between profiles 6 and 8 and vertical wall 2.

Such restraint is made by means of self-threading screws whereby the profiles 6 and 8 engage the body of panel 2.

I claim:

1. A protective peripheral cornice of a building wherein the walls and the top roof are both formed with modular panels of common dimensions a cornice that is an equal angle broad flanged beam is inserted between the top of the wall and the end section of said roof which cornice with its inner surface of its vertical flange covers the end of the ceiling and with its inner surface of its horizontal flange covers the terminal section of the ceiling; while the outer surface of its horizontal flange covers the top surface of the wall and projects from the latter for about $\frac{1}{4}$ of the wall thickness while the outer surface of the vertical flange is exposed to the atmosphere, said cornice being made of light material which is totally enveloped in a metal sheet except for two interruptions where the sheet is replaced by bridge-like means of insulating plastic material which extend for about $\frac{1}{2}$ the panel thickness; one of said interruptions being located across the horizontal median plane of the ceiling panel while the other is located across the vertical median plane of the wall panel.

2. A cornice as claimed in claim 1 wherein said bridgelike longitudinal means comprises a flat desk which extends for the same lenght as said cornice the longitudinal axis of which deck lying in the mean centerline of the panel thickness at the end thereof said deck being provided along its sides with symmetrical clamping edges for engaging corresponding clamping edges of the interrupted enveloping sheet of said broad flanged beam and making with them a pair of folded seams for each of said interruptions the distance between the seams of each interruption being about one half the panel thickness.

3. A cornice as claimed in claim 1 wherein the inner and outer surface top sections of said wall are both covered by a pair of doubled metal sheet sections which extend downwards from the metal sheet by which the horizontal outer flange of said beam is enveloped; said doubled metal sheet sections being adherent to said building wall.

* * * * *